US005745927A

United States Patent [19]

Hoareau

[11] Patent Number: 5,745,927

[45] Date of Patent: May 5, 1998

[54] APPARATUS FOR LAVATORY BOWL VENTILATION

[76] Inventor: Desire Dominique Hoareau, 67 Peel Street, Mandurah, Western Australia, Australia, 6210

[21] Appl. No.: 770,247

[22] Filed: Dec. 20, 1996

[51] Int. Cl.[6] ..... E03D 9/052

[52] U.S. Cl. ..... 4/213; 4/216

[58] Field of Search ..... 4/213, 217, 218, 4/347, 216, 352, 209 R, 211

[56] References Cited

U.S. PATENT DOCUMENTS

| | | | |
|---|---|---|---|
| 1,449,250 | 3/1923 | Ribley | 4/217 |
| 1,461,139 | 7/1923 | Paul | 4/209 R |
| 1,636,476 | 7/1927 | Lumley | 4/216 |
| 1,706,021 | 3/1929 | Blanchard | 4/213 |
| 2,190,068 | 2/1940 | Henschler | 4/213 |
| 3,020,564 | 2/1962 | Chodacki et al. | 4/213 |
| 3,896,509 | 7/1975 | Stipp et al. | 4/218 |
| 3,999,225 | 12/1976 | Ables | 4/217 |
| 4,882,790 | 11/1989 | Ricard | 4/213 |
| 5,010,600 | 4/1991 | Prisco . | |
| 5,170,512 | 12/1992 | Prisco . | |
| 5,179,737 | 1/1993 | Ricard | 4/213 |
| 5,491,847 | 2/1996 | Shaffer . | |
| 5,522,093 | 6/1996 | Schaffer . | |

FOREIGN PATENT DOCUMENTS

| | | | |
|---|---|---|---|
| 2202611 | 7/1973 | Germany | 4/213 |
| 2233679 | 1/1991 | United Kingdom . | |
| 2266901 | 11/1993 | United Kingdom . | |

*Primary Examiner*—Charles R. Eloshway
*Attorney, Agent, or Firm*—Holland & Hart LLP

[57] ABSTRACT

An apparatus (10) for lavatory bowl ventilation comprising a switch (12) locatable on an exhaust fan (20), a nozzle (14) adapted to be positioned in or adjacent a bowl (46) of a lavatory pedestal (28), a conduit (16) and an actuator (56), the actuator (56) being activated upon lifting of a lid (34) of the lavatory pedestal (28) and causing switching of the switch (12) located on the exhaust fan (20) and causing air and odors to be drawn through the nozzle (14) and the conduit (16) to the exhaust fan (20).

11 Claims, 7 Drawing Sheets

APPARATUS FOR LAVATORY BOWL VENTILATION

The present invention relates to an apparatus for lavatory bowl ventilation. More particularly, the apparatus of the present invention is intended for fitting to an existing lavatory bowl and exhaust fan.

Many lavatories have extraction/exhaust fans fitted either in a wall or ceiling thereof in an effort to draw away odours. Typically such extraction fans are located remotely with respect to the lavatory bowl and their effectiveness is consequently limited. For example, odours are not prevented from being apparent to the user of the lavatory or a user immediately following. The location of most extraction fans results in a time delay for extraction of odours. This problem is accentuated by the fact that many fans are activated by a light switch turned on/off on entering/leaving the lavatory. Often the fan is deactivated before all odours are evacuated.

The apparatus for lavatory bowl ventilation of the present invention has as one object thereof to overcome the above problems.

In accordance with the present invention there is provided an apparatus for lavatory bowl ventilation comprising a switching means locatable on an exhaust fan, a nozzle means adapted to be positioned in or adjacent a bowl of a lavatory pedestal, a conduit and an actuation means, said actuation means being activated upon lifting of a lid of said lavatory pedestal and causing switching of said switching means located on said exhaust fan and causing air and odours to be drawn through said nozzle means and said conduit to said exhaust fan.

Preferably, said switching means comprises a housing that may be received on said exhaust fan. Said switching means may further comprise a movable portion thereof that is movable between open and closed positions by the said actuation means. The open and closed positions describing states in which said exhaust fan may draw air from said lavatory or bathroom as a whole and one in which air is drawn through said conduit from said nozzle and said lavatory bowl, respectively.

Said nozzle means is preferably proportioned so as to be positioned between a seat and said lavatory bowl. Further, said nozzle means may be provided in a horseshoe shape so as to extend at least partially around a rim of said lavatory bowl.

Still preferably, said actuation means may comprise a line attached to said lid and passing through said conduit to said movable portion of said switching means. Said movable portion preferably being provided with a return mechanism such that upon lowering of said lavatory lid said switching means may return to its open position.

In accordance with the present invention there is further provided a kit for the installation of an apparatus for lavatory bowl ventilation comprising, said kit comprising a switching means, a nozzle means, a conduit and an actuation means, said switching means being locatable on an exhaust fan such that air and odours may be drawn through said nozzle means and said conduit to said exhaust fan.

Preferably, a length of conduit greater than that expected to be necessary will be provided in said kit. Still preferably, said switching means comprises in part a housing adapted to be installed directly onto said exhaust fan.

The apparatus for lavatory bowl ventilation of the present invention comprises a switching means, a nozzle means and a conduit. The switching means comprises a housing locatable over an exhaust fan provided in a ceiling of a lavatory.

The conduit extends from a rear portion of a lavatory pedestal and projects along a rear wall and the ceiling of the lavatory. The conduit may have elbows provided therein. It is to be understood that more or less elbows may be provided without altering the scope of the present invention.

The lavatory pedestal has a lid provided thereon in a hinged manner. A seat is typically also provided. The seat is provided to rest on a rim of the pedestal between same and the lid.

The nozzle means is located on the rim of the pedestal. Further, the nozzle means is formed in a semi-circular or horseshoe shape having two arms extending from a junction with the conduit. The arms have an inner face thereof provided with a plurality of apertures. As such, the apertures are directed over or into a bowl of the pedestal. The apertures provide access into a hollow interior of the nozzle means and conduit.

The conduit projects between a pair of upstanding hinges provided, in known manner, on the rear portion of the pedestal and also between the rear portion and the lid. The conduit is of a generally rectangular profile defining therein a hollow interior.

The conduit has an elongate slit provided therein and through which an arm provided on the lid projects. An end of the arm is rigidly formed with or attached to the lid and projects through the slit and into the hollow interior of the conduit.

The switching means comprises a movable portion 58 and a fixed portion 60. The movable portion is movable with respect to at least the fixed portion. The movable portion is provided in the form of a substantially flat plate having an array of apertures provided therein whereas the fixed portion is provided with a complimentary array of apertures. An open position of the switching means allows air to be drawn from the exhaust fan through the switching means in a generally normal manner. A closed position of the switching means is such that the apertures are not aligned and the exhaust fan must then draw air through the conduit.

The movable portion has attached thereto, at opposite sides, the line and a return mechanism, for example a spring. The return mechanism is also attached to the housing. The spring acts to return the movable portion to the open position and acts against any pulling force exerted on the movable portion by the line.

The or each elbow may be provided with a member of circular section extending transversely thereacross. A sleeve is provided about the member and has a guide notch located therein. The line is preferably located in the notch.

The present invention will now be described, by way of example only, with reference to one embodiment thereof and the accompanying drawings, in which FIG. 1 a side elevational view of a lavatory and exhaust fan to which an apparatus for lavatory bowl ventilation in accordance with one embodiment of the present invention has been fitted (cistern not shown for ease of description);

Figure 1:
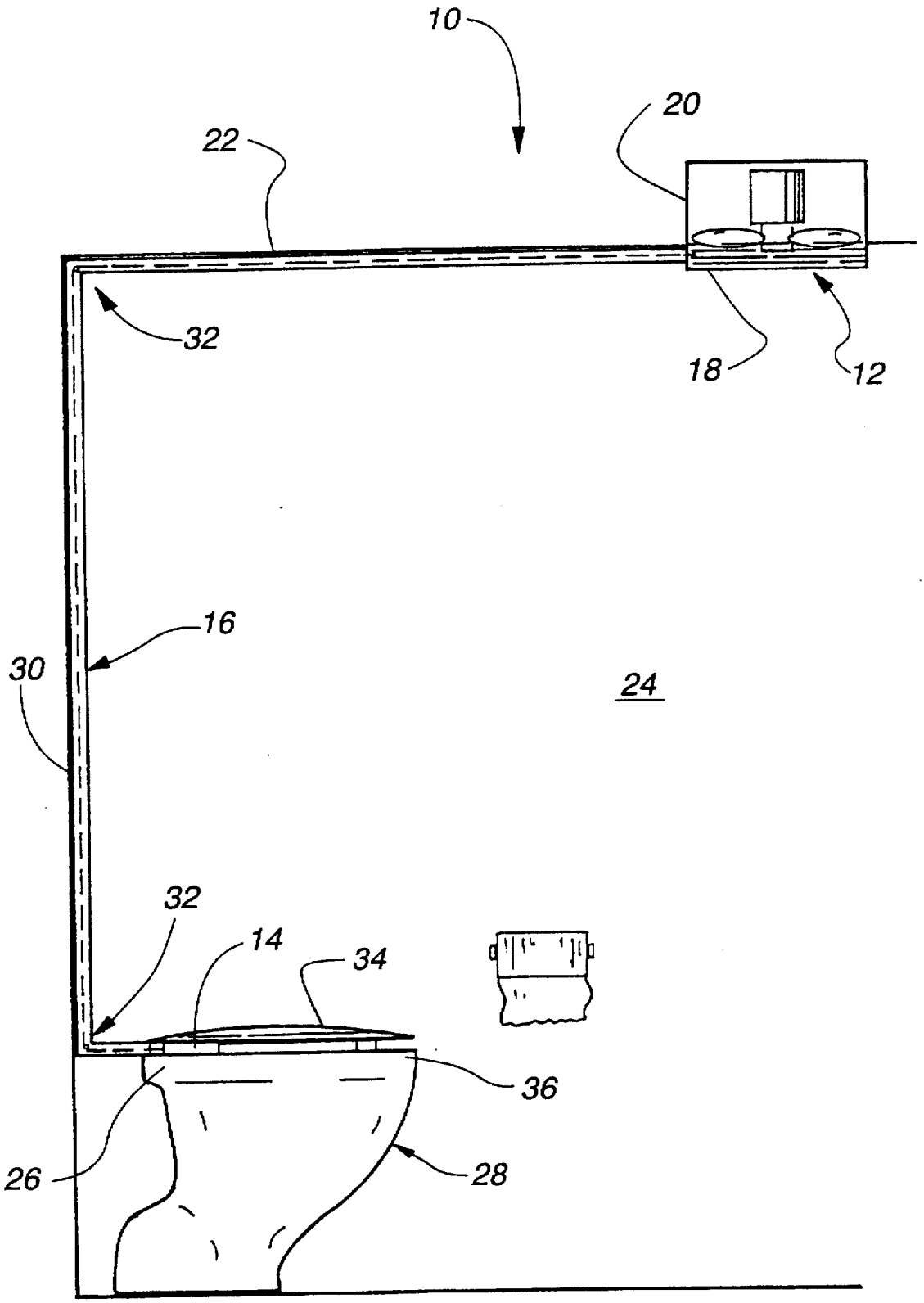

In FIG. 1 there is shown an apparatus for lavatory bowl ventilation 10 comprising a switching means 12, a nozzle means 14 and a conduit 16. The switching means 12 comprises a housing 18 locatable over an exhaust fan 20 provided in a ceiling 22 of a lavatory or bathroom 24.

The conduit 16 extends from a rear portion 26 of a lavatory pedestal 28 and projects along a rear wall 30 and the ceiling 22 of the lavatory 24. The conduit 16 has two elbows 32 provided therein. It is to be understood that more or less elbows 32 may be provided without altering the scope of the present invention.

The lavatory pedestal 28 has a lid 34 provided thereon in a hinged manner and shown in a closed or down position. A seat (not shown) is typically also provided but is not shown for clarity of description. The seat is provided to rest on a rim 36 of the pedestal 28 between same and the lid 34.

Figure 2:
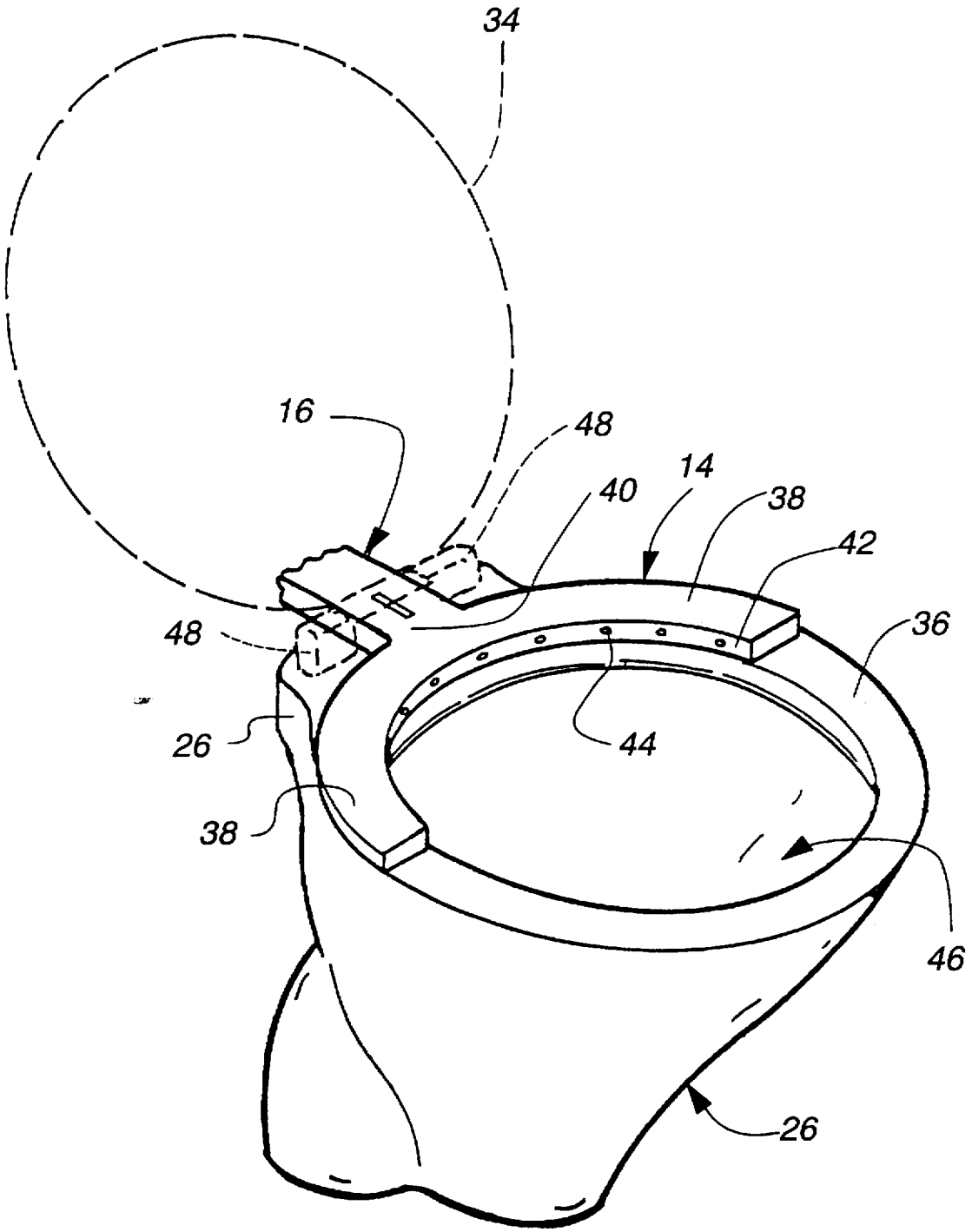
FIG. 2 is an upper perspective view of the lavatory bowl of FIG. 1 showing the nozzle means provided on the rim of the bowl and showing the lavatory lid in the up position (the lavatory seat is not shown for ease of definition)

In FIG. 2 there is shown the rim 36 of the pedestal 28 having the nozzle means 14 located thereon. The nozzle means 14 is formed in a semi-circular or horseshoe shape having two arms 38 extending from a junction 40 with the conduit 16. The arms 38 have an inner face 42 thereof provided with a plurality of apertures 44. As such, the apertures 44 are directed over or into a bowl 46 of the pedestal 28. The apertures 44 provide access into a hollow interior of the nozzle means 14 and conduit 16.

Figure 3:
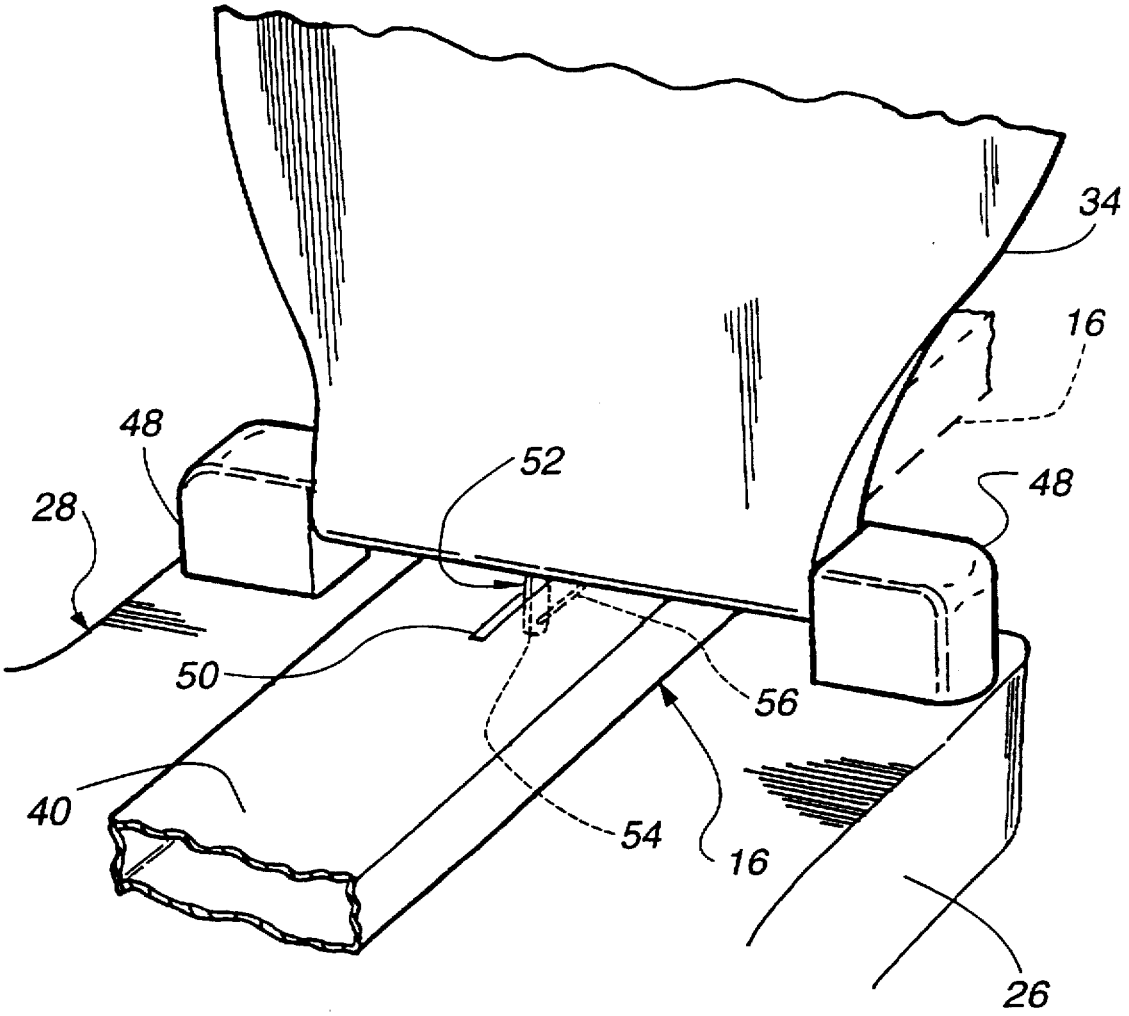
FIG. 3 is an upper perspective view of the mounting of the lavatory lid to the bowl showing the passage of the conduit therebetween and the arm extending from the lid into the conduit.

The conduit 16 projects between a pair of upstanding hinges 48 provided, in known manner, on the rear portion 26 of the pedestal 28 and also between the rear portion 26 and the lid 34, as can be seen in FIG. 3. The conduit 16 is of a generally rectangular profile defining therein a hollow interior.

Figure 4:
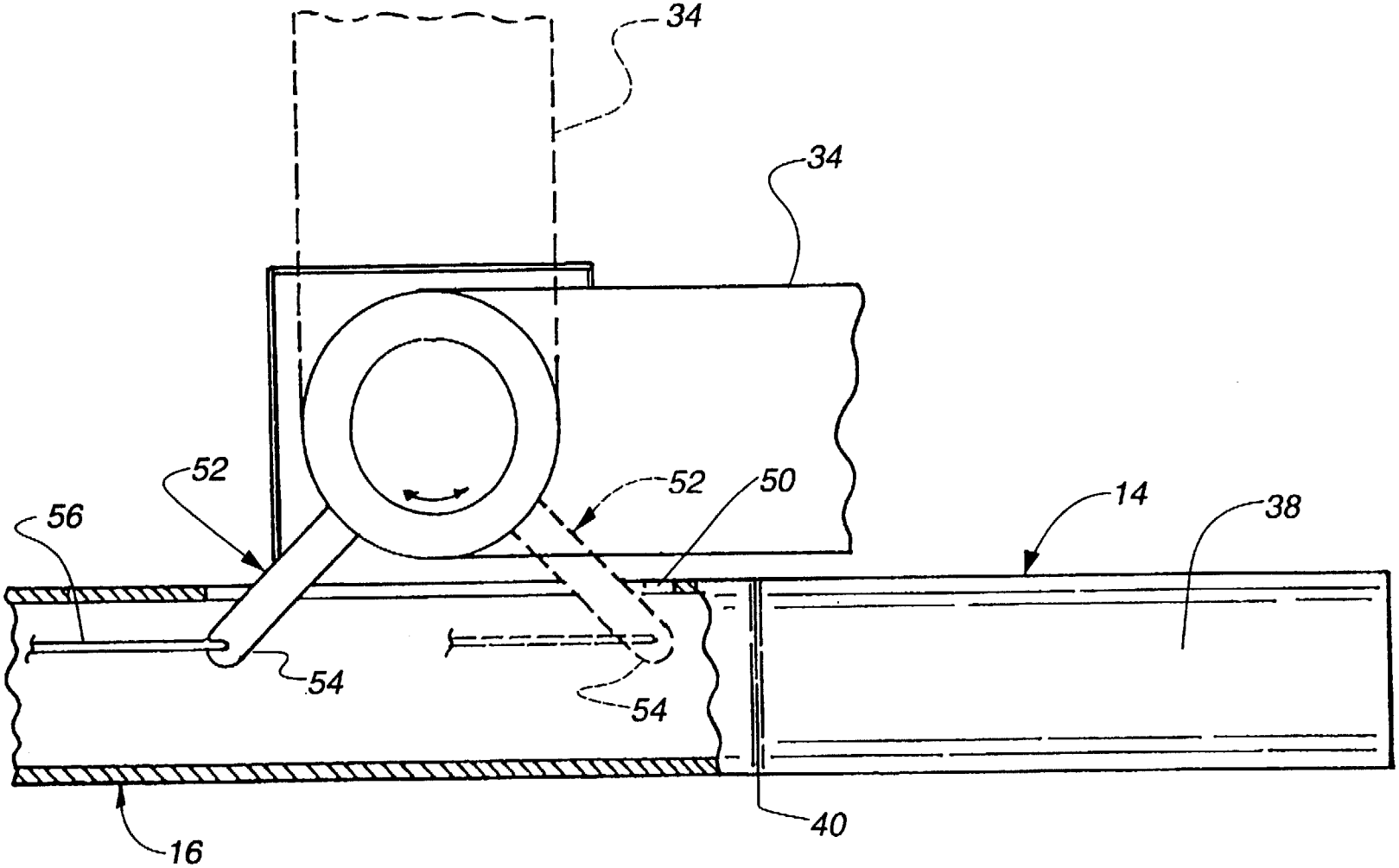
FIG. 4 is a partially cross-sectional side elevational view of the conduit and lid of FIG. 3 showing the lid in both closed and open (in phantom) positions.

The conduit 16 has an elongate slit 50 provided therein and through which an arm 52 provided on the lid 34 projects. An end 54 of the arm 52 is rigidly formed with or attached to the lid 34 and projects through the slit 50 and into the hollow interior of the conduit 16, as is best seen in FIG. 4.

Figure 5:
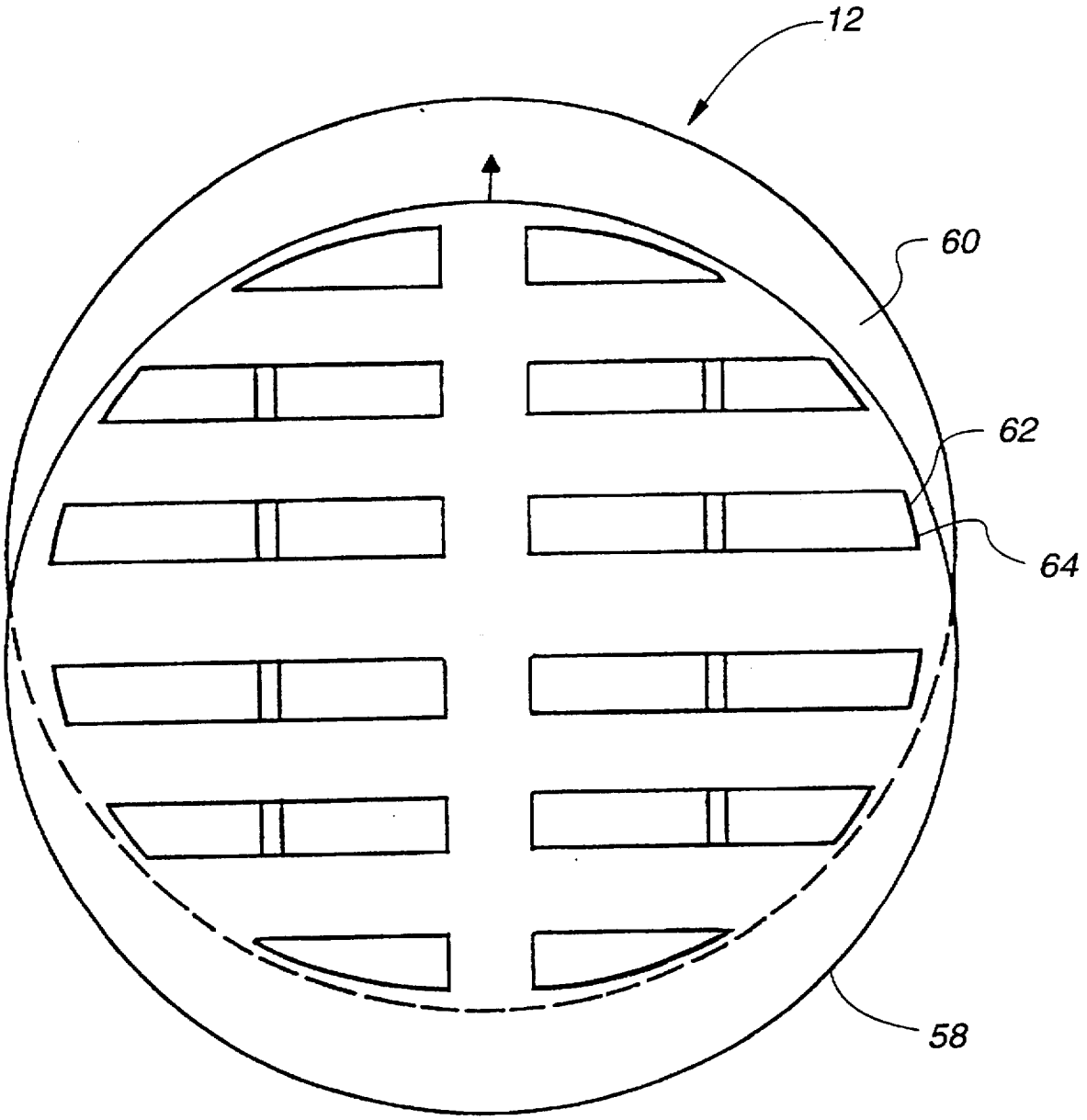
FIG. 5 is a plan view of a switching means of the apparatus of FIG. 1 showing same in an open position.
Figure 6:
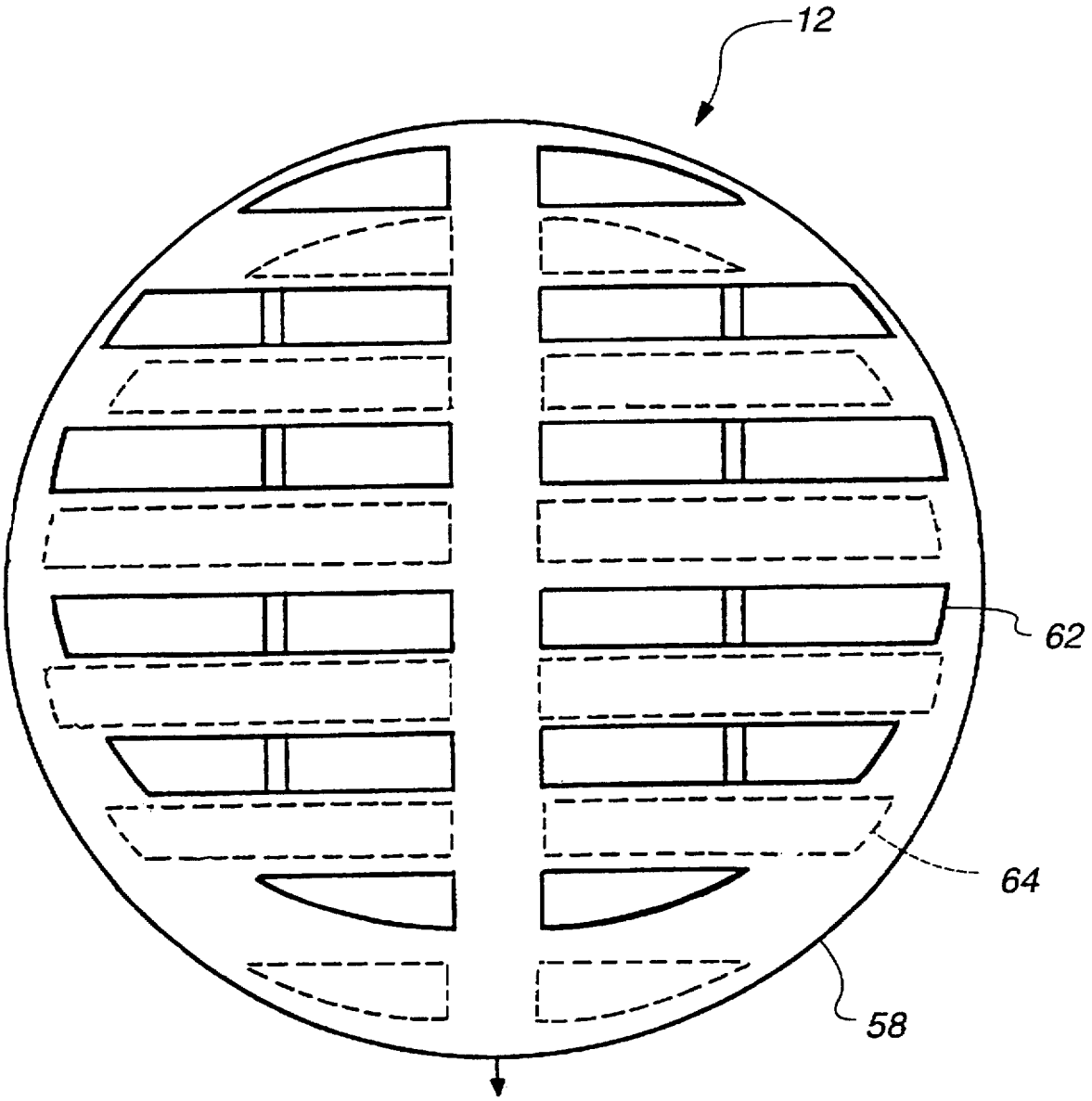
FIG. 6 is a plan view of the switching means of FIG. 5 shown in a closed position.

In FIGS. 5 and 6 there are shown a movable portion 58 and a fixed portion 60 of the switching means 12. The movable portion 58 is movable with respect to at least the fixed portion 60. The movable portion 58 is provided in the form of a substantially flat plate having an array of apertures 62 provided therein whereas the fixed portion 60 is provided with an array of apertures 64, best seen in FIG. 6. The apertures 62 and 64 are complimentary as shown in FIG. 5. An open position of the switching means 12 is shown in FIG. 5 which allows air to be drawn from the exhaust fan 20 through the switching means 12 in a generally normal manner. A closed position of the switching means 12 is shown in FIG. 6 in which the apertures 62 and 64 are not aligned and the exhaust fan 20 must then draw air through the conduit 16.

The movable portion 58 has attached thereto, at opposite sides, the line 56 and a return mechanism, for example a spring (not shown). The return mechanism is also attached to the housing 20. The spring acts to return the movable portion 58 to the open position shown in FIG. 5 and acts against any pulling force exerted on the movable portion 58 by the line 56.

Figure 7:
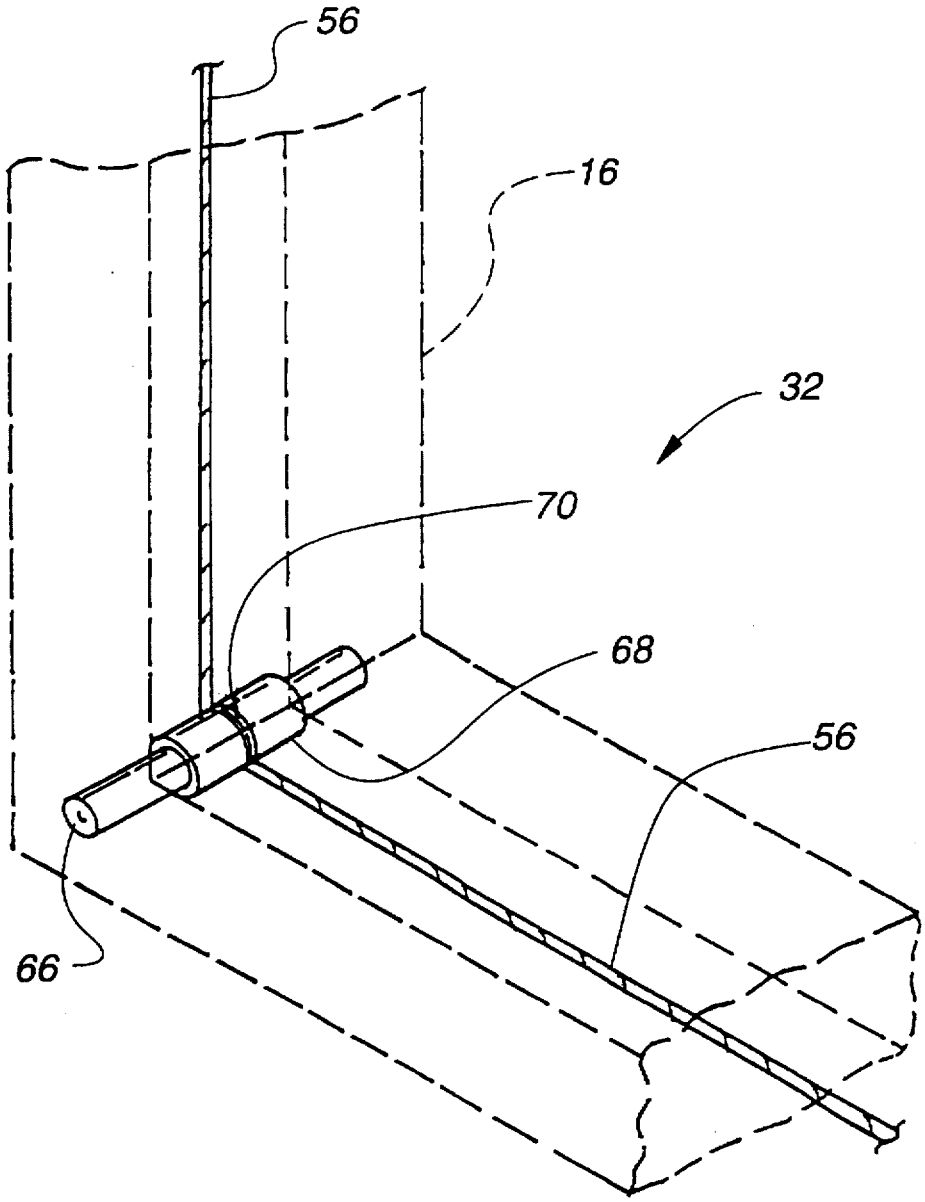
FIG. 7 is an upper perspective view of an elbow of the conduit of the apparatus of FIG. 1 showing a line passing about a roller sleeve at the elbow.

In FIG. 7 there is shown one of the elbows 32 in the conduit 16. The elbow 32 is provided with a member 66 of circular section extending transversely thereacross. A sleeve 68 is provided about the member 66 and has a guide notch 70 located therein. The line 56 is preferably located in the notch 70.

In use, the apparatus for lavatory bowl ventilation 10 may be installed simply by removing the lavatory lid and seat from the pedestal 28 and positioning the nozzle means 14. Suitable lengths of the conduit 16 may then be provided to extend to the rear wall 30 of the lavatory 24, up the rear wall 30 and across the ceiling 22 to the ceiling fan 20. The housing 18 of the switching means 12 may preferably snap-fit or press-fit to the ceiling fan 20 as a replacement for the normal grill found on typical ceiling fans. The seat and lid 34 may be reattached to the pedestal 38 and may operate in known manner.

It is envisaged that the apparatus 10 of the present invention may be installed such that the conduit 16 passes through the interior of the wall 30 and ceiling 22. In this manner the apparatus 10 of the present invention may be installed on new homes during construction.

A user wishing to use the lavatory or bathroom 24 will enter same and activate the exhaust fan 20, possibly through activation of a light switch or by activation of an independent switch. At this time the lid 34 of the apparatus 10 is in a lowered or down position whereby the switching means 12 is in the open position, shown in FIG. 5. In this position air is drawn by the exhaust fan 20 from the lavatory or bathroom 24 in known manner as the apertures 62 and 64 of the movable portion and fixed portion of the switching means 12 respectively are aligned.

The user will then lift the lid 34 of the lavatory pedestal 28 thereby causing movement of the arm 52 projecting from the lid 34 into the conduit 16. With reference to FIG. 4, the arm 52 will move from that position shown in full lines to that position illustrated in phantom. The arm 52 travels through or along the slit 50 provided in the conduit 16. The slit 50 may have provided therein a felt or similar material to prevent dust and other particles entering the conduit 16.

The travel induced in the arm 52 and illustrated in FIG. 4 results in activation of the line 56. The line 56 is effectively pulled through the action of the arm 52 causing such pulling action to be transferred through the conduit 16 to the switching means 12 attached to the exhaust fan 20. The line 56 is attached to the movable portion 58 of the switching means 12 causing same to move to that position shown in FIG. 6 and referred to as the closed position. As the exhaust fan 20 cannot draw air through the closed switching means 12 air is drawn through the conduit 16 from the nozzle means 14. This action causes air and odours from the lavatory bowl 46 to be drawn through the apertures 44 and into the hollow interior of the nozzle means 14 and conduit 16.

It is envisaged that the arms 38 of the nozzle means 14 may extend for shorter or longer distances along the rim 36 of the lavatory pedestal 28. It is further envisaged that the movable portion 58 and fixed portion 60 of the switching means 12 may be provided with any complimentary pattern of apertures. For example, an array of complimentary apertures may be provided with each aperture being of circular dimension.

It is still further envisaged that the switching means, nozzle means and conduit may each be formed of moulded plastics material. The line of the actuation means may be formed of nylon, wire, string or similar. Such is not intended to limit the scope of the present invention.

The apparatus for lavatory bowl ventilation 10 of the present invention consequently provides a method of extracting odours directly from the lavatory bowl rather than simply from the lavatory as a whole. This results in more rapid and effective extraction of odours whilst utilising an exhaust fan typically found in most lavatories.

Modifications and variations such as would be apparent to the skilled addressee are considered to fall within the scope of the present invention.

I claim:

1. An apparatus for lavatory bowl ventilation comprising a switching means having a movable portion and adapted to be located on an exhaust fan, a nozzle means adapted to be positioned in or adjacent a bowl of a lavatory pedestal, a conduit and an actuation means, said actuation means being activated upon lifting of a lid of said lavatory pedestal causing switching of said switching means, which causes air and odours to be drawn through said nozzle means and said conduit to said exhaust fan, said actuation means comprising a line adapted to be attached to the lid of the lavatory pedestal and passing through said conduit to said switching means, said line being attached to and able to induce movement in the movable portion of said switching means.

2. An apparatus according to claim 1, wherein said switching means comprises a housing that is adapted to be received on said exhaust fan.

3. An apparatus according to claim 1, wherein said movable portion is moved between open and closed positions by said actuation means.

4. An apparatus according to claim 3, wherein said open and closed positions describe states in which said exhaust fan draws air from either a lavatory room or bathroom in which said lavatory bowl is located or through said conduit from said nozzle or lavatory bowl, respectively.

5. An apparatus according to claim 1, wherein said nozzle means is proportioned so as to be positioned between a seat and said bowl of said lavatory pedestal.

6. An apparatus according to claim 1, wherein said nozzle means is provided in a substantially semi-circular shape extending at least partially around a rim of said lavatory bowl, said nozzle means having an inner face thereof facing said lavatory bowl and having located therein a plurality of apertures, opening from said inner face into a hollow interior thereof.

7. An apparatus according to claim 1, wherein said lid has provided thereon an arm projecting into said conduit through an aperture provided therein, said line being adapted to be attached to said arm such that movement of said lid is transferred through said arm to said line and in turn to said switching means.

8. An apparatus according to claim 1, wherein one or more elbows are provided in said conduit, at least one said elbow having a member provided therein about which said line passes.

9. An apparatus according to claim 8, wherein said member has a sleeve provided thereabout, said sleeve having a guide notch located therein to positively locate said line with respect thereto.

10. A kit for the installation of an apparatus for lavatory bowl ventilation, said kit comprising a switching means having a movable portion and adapted to be located on an exhaust fan, a nozzle means adapted to be positioned in or adjacent a bowl of a lavatory pedestal, a conduit and an actuation means, said actuation means comprising a line adapted to be attached to a lid of the lavatory pedestal and to pass through said conduit to said switching means, said line being attached to and able to induce movement in the movable portion of said switching means, whereby said actuation means is activated upon lifting of the lid of said lavatory pedestal causing switching of said switching means, which causes air and odours to be drawn through said nozzle means and said conduit to said exhaust fan.

11. A kit according to claim 10, wherein said switching means comprises in part a housing adapted to be installed directly onto the exhaust fan.

* * * * *